United States Patent [19]

Hastings et al.

[11] Patent Number: 4,739,935

[45] Date of Patent: Apr. 26, 1988

[54] FLEXIBLE VOLTAGE CABLE FOR ELECTROSTATIC SPRAY GUN

[75] Inventors: Donald R. Hastings, Elyria; John Sharpless, Oberlin, both of Ohio; George H. Morin, Dracut, Mass.

[73] Assignee: Nordson Corporation, Amherst, Ohio

[21] Appl. No.: 839,128

[22] Filed: Mar. 12, 1986

[51] Int. Cl.[4] ..... B05B 5/02; H01C 1/028

[52] U.S. Cl. ..... 239/690; 338/214; 174/102 SC

[58] Field of Search ..... 239/3, 690–708; 338/214, 216; 174/102 SC, 120 SC

[56] References Cited

U.S. PATENT DOCUMENTS

| | | | |
|---|---|---|---|
| 2,090,510 | 8/1937 | Bower . | |
| 2,861,163 | 11/1958 | Asakawa . | |
| 2,926,106 | 2/1960 | Gauthier . | |
| 2,989,241 | 6/1961 | Badger . | |
| 3,009,441 | 11/1961 | Juvinall . | |
| 3,021,077 | 2/1962 | Gauthier . | |
| 3,048,498 | 8/1962 | Junivall et al. . | |
| 3,063,642 | 11/1962 | Point . | |
| 3,072,341 | 1/1963 | Point et al. . | |
| 3,128,045 | 4/1964 | Gauthier . | |
| 3,167,255 | 1/1965 | Point et al. . | |
| 3,178,114 | 4/1965 | Point . | |
| 3,536,514 | 10/1970 | La Fave et al. . | |
| 3,749,817 | 7/1973 | Shiga et al. | 174/102 SC |
| 3,792,409 | 2/1974 | Smart et al. | 338/214 |
| 3,826,425 | 7/1974 | Scharfenberger et al. . | |
| 3,843,054 | 10/1974 | Kendall et al. . | |
| 3,844,477 | 10/1974 | Pollard et al. . | |
| 3,870,987 | 3/1975 | Wiley et al. | 338/214 |
| 3,873,024 | 3/1975 | Probst et al. . | |
| 3,991,397 | 11/1976 | King | 338/214 |
| 4,018,977 | 4/1977 | Herrmann, Jr. et al. | 174/24 |
| 4,100,233 | 7/1978 | Yajima et al. . | |
| 4,103,276 | 7/1978 | Kennon et al. | 338/214 |
| 4,143,238 | 3/1979 | Sheth | 174/107 |
| 4,187,389 | 2/1980 | Foote et al. | 174/73 R |
| 4,309,597 | 1/1982 | Crowley | 338/214 X |
| 4,357,526 | 11/1982 | Yamamoto et al. | 219/544 |
| 4,369,423 | 1/1983 | Holtzberg | 338/66 |
| 4,373,006 | 2/1983 | Galasso et al. | 428/368 |
| 4,383,132 | 5/1983 | Bartvelsen et al. | 174/102 SC X |
| 4,426,568 | 1/1984 | Kato et al. | 219/270 |
| 4,443,361 | 4/1984 | Hierholzer, Jr. et al. | 338/330 X |
| 4,576,827 | 3/1986 | Hastings et al. | 239/691 X |
| 4,584,431 | 4/1986 | Tippie et al. | 174/102 SC X |
| 4,634,058 | 1/1987 | Hollstein et al. | 239/697 |

*Primary Examiner*—Andres Kashnikow
*Assistant Examiner*—Kevin Patrick Weldon
*Attorney, Agent, or Firm*—Wood, Herron & Evans

[57] ABSTRACT

An electrostatic spray system including a spray device having an electrode for electrostatically charging coating particles emitted from the spray device toward an article to be coated, a high voltage electrostatic supply, and a high voltage insulated electrical cable interconnecting the electrostatic supply and the spray device electrode. The high voltage cable includes a fibrous resistive core, preferably fabricated from silicon carbide fibers, a fiber-restraining layer of insulative thread tightly wrapped spirally around the entirety of the core to prevent fiber ends from projecting outwardly from the core, an outer dielectric sheath, and an intermediate sheath sandwiched between the spirally wound inner fiber-restraining layer and the outer dielectric sheath and having a resistivity lying between that of the inner resistive fiber core and the outer dielectric sheath. The intermediate sheath provides uniform voltage stress distribution in the region surrounding the resistive core, thereby avoiding internal corona sites which cause degradation of the outer dielectric sheath, which might otherwise occur due to the very small diameter of the resistive core coupled with the very high operating voltages used in electrostatic spray coating operations. The intermediate sheath also avoids high voltage stresses at the ends of stray resistive fibers projecting through the spirally wound layer, which might otherwise occur due to the extremely small diameter of the projecting fibers.

33 Claims, 1 Drawing Sheet

FLEXIBLE VOLTAGE CABLE FOR ELECTROSTATIC SPRAY GUN

This invention relates to electrostatic spray coating systems, and more particularly to a high voltage cable particularly adapted for use in such systems.

This application discloses and claims subject matter related to that of pending application Ser. No. 602,974, filed Apr. 23, 1984, in the name of Donald R. Hastings and John Sharpless, entitled "Electrostatic Spray Coating System", now U.S. Pat. No. 4,576,827, assigned to the assignee of the present application.

The above-referenced Hastings et al application discloses, among other things, a high voltage insulated electrical cable for use in interconnecting the particle high charging electrode of a spray coating device with a high voltage electrostatic supply. In a preferred form, the Hastings et al cable includes a resistive core of continuous silicon carbide fibers for conducting current longitudinally along the length thereof, a carbon-loaded polypropylene sheath extruded around the silicon carbide fiber core, and a dielectric sheath of polyethylene extruded around the carbon-loaded polypropylene. The resistivity of the carbon-loaded polypropylene sheath lies between the resitivities of the resistive silicon carbide fiber core and the outer dielectric sheath. To facilitate pulling the resistive silicon carbide fiber core through the extruder, three strands of 1100 denier Dacron brand polyester is twisted with the silicon carbide fibers around the core such that there is a full twist every 0.5 inches of core length.

The function of the carbon-filled polypropylene intermediate sheath in the Hastings et al cable is to avoid large voltage gradients at the location of a broken silicon carbide filament should a silicon carbide filament break somewhere along the length of the cable. At the location of a broken silicon carbide filament, the broken ends of the filament may project radially outwardly from the resistive core between the twisted Dacron strands. In view of the extremely small diameter of the silicon carbide filament, which may be on the order of 0.0005 inches, or 15 microns, the projecting ends of the broken silicon carbide filament create very high voltage gradients. By embedding the outwardly projecting ends of the broken silicon carbide filament in the relatively highly resistive intermediate sheath, the high voltage gradients that would otherwise tend to occur are markedly reduced. This, in turn, reduces the tendency of the outer dielectric sheath used to insulate the silicon carbide core for high voltage operation to prematurely fail at the site of the broken silicon carbide filament ends. The relatively high resistive intermediate sheath surrounding the silicon carbide fiber core of the Hastings et al application also serves to reduce voltage stresses in the outer dielectric sheath occasioned by the very small diameter of the core itself, which in a preferred form is 0.035 inches.

It has been discovered that while the intermediate sheath of carbon-loaded polymer disclosed in the Hastings et al application does tend to provide uniform voltage stress distribution around the extremely small diameter silicon carbide fiber core, thereby reducing internal corona sites which can degrade the outer dielectric sheath, there is still some tendency for stray silicon carbide fiber ends occasioned by broken filaments to create internal corona discharges at localized sites within the cable, eventually creating pin holes in the outer dielectric sheath, which ultimately lead to cable failures.

Accordingly, it has been an objective of this invention to provide a high voltage insulated electric cable having a fibrous resistive core which is substantially free of outwardly projecting fiber ends which create internal corona discharge sites and ultimately degrade the outer dielectric sheath, resulting in cable failure. This objective has been accomplished in accordance with certain principles of the invention by encasing the entire inner fibrous silicon carbide core with a tightly wound layer of insulative thread, for example, Dacron polyester, in which the adjacent convolutions of the spirally wound thread are in close physical contact with each other. By making the pitch of the spirally wound Dacron thread equal to the thread diameter, the entire silicon carbide fiber core is encased in thread. This mats down the stray ends of any broken silicon carbide fibers, preventing them from projecting outwardly from the resistive core which, as noted, if permitted to occur can create local corona sites which lead to degradation of the outer dielectric sheath and, in turn, cable failure.

With the cable of the Hastings et al application, another potential source of internal corona, tending to degrade the outer dielectric sheath, and eventually producing cable failure, was found to exist. More particularly, it has been discovered that in the region of the interface between the carbon-loaded polypropylene intermediate layer and the outer dielectric polyethylene layer, voids or spaces exist. Notwithstanding that these voids or spaces are extremely small, they nevertheless tend to create voltage stress concentrations whereat corona can occur, degrading the outer dielectric sheath, leading to failure of the cable.

It has been a further objective of this invention to provide a high voltage cable having a carbon-loaded polymer layer between the inner resistive silicon carbide fiber core and the outer dielectric sheath, which is free of corona-inducing voids or spaces at the interface between the carbon-loaded sheath and the outer dielectric layer. This objective has been accomplished in accordance with certain further principles of the invention by bonding the carbon-loaded intermediate sheath and the outer dielectric sheath at their interface such that the outer surface of the intermediate sheath and the inner surface of the outer dielectric sheath are in intimate physical contact throughout, thereby providing a void-free interface between them. In a preferred form of the invention the desired void-free interface condition is achieved by using the same polymer for both interfacing layers allowing the two layers to blend together at their interface. This interface blending eliminates corona-inducing voids.

These and other advantages, features, and objectives of the invention will be more readily apparent from a detailed description thereof taken in conjunction with the drawings, in which.

Figure 1:
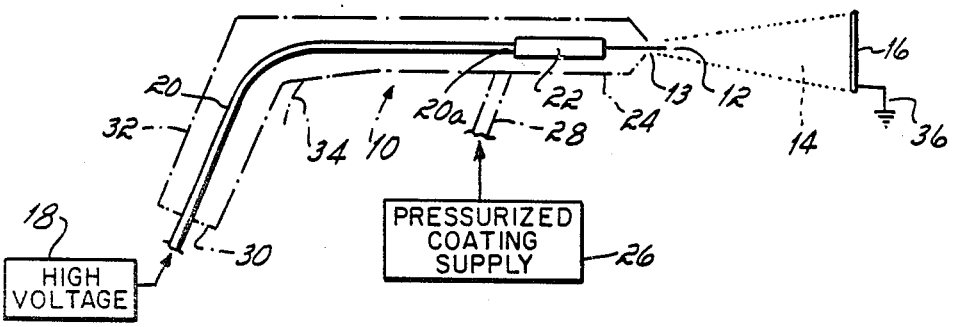
FIG. 1 is a side elevational view of an electrostatic spray system schematically illustrating the high voltage cable of this invention interconnecting a remote high voltage electrostatic supply and a conventional discrete high voltage resistor incorporated in the spray device which connects to the coating particle charging electrode projecting from the spray device nozzle.

The electrostatic spray coating system depicted in FIG. 1, which incorporates the improved insulated high voltage cable of this invention, includes an electrostatic spray gun 10 having a charging electrode 12 extending forwardly from the gun nozzle whereat the coating material particles are emitted in a spray pattern 14 toward an article to be coated 16. High voltage electrostatic potential is supplied to the electrode 12 from a remotely located high voltage electrostatic supply 18 via the electrically insulated cable 20 of this invention and a gun resistor 22 located between the forward end of the cable 20*a* and the electrode. The gun resistor 22 typically has a value of approximately 75 megohms, and the cable 20 has a resistance of approximately 200 megohms. In addition to the gun resistor 22 located in the barrel 24 of the spray gun 10, there may be an auxiliary discrete gun resistor of lesser value, for example, 12 megohms, which is not shown in FIG. 1. The auxiliary resistor, if provided, is electrically connected between the gun resistor 22 and the electrode 12 immediately rearwardly of the electrode. Plural discrete gun resistors in electrostatic spray devices are known in the art. An illustration of such is disclosed in Kennon U.S. Pat. No. 4,182,490, granted Jan. 8, 1980, entitled "Electrostatic Spray Gun", assigned to the assignee of the present application. Also included in the spray coating system depicted in FIG. 1 is a source of pressurized coating material 26, such as powder or liquid, which is transported to the spray device 10 via a hose or conduit 28. To facilitate convenient maneuvering of the spray device 10 relative to an article 16 to be coated, the hose 28 is fabricated of flexible material. For the same reason, the cable 20 is flexible, particularly in the region between the high voltage supply 18 and the butt 30 of the spray device handle 32 whereat the cable enters the spray device 10.

In operation, when a trigger 34 of the spray device 10 is actuated, high voltage is applied to the electrode 12 from the supply 18 via the cable 20 and gun resistor 22 for electrostatically charging coating particles emitted from the nozzle 13 supplied to the gun from the pressurized supply 26 via hose 28. The electrostatically charged particles in the spray pattern 14 are directed toward the article being coated 16, which is maintained at a potential, such as ground 36, which is substantially different than that of the electrode 12. By reason of the grounded nature of the article 16 and the charge on the coating particles in pattern 14, the charged coating particles are electrostatically attracted toward the article being coated 16 whereat they are deposited with enhanced coating transfer efficiency.

Figure 2:
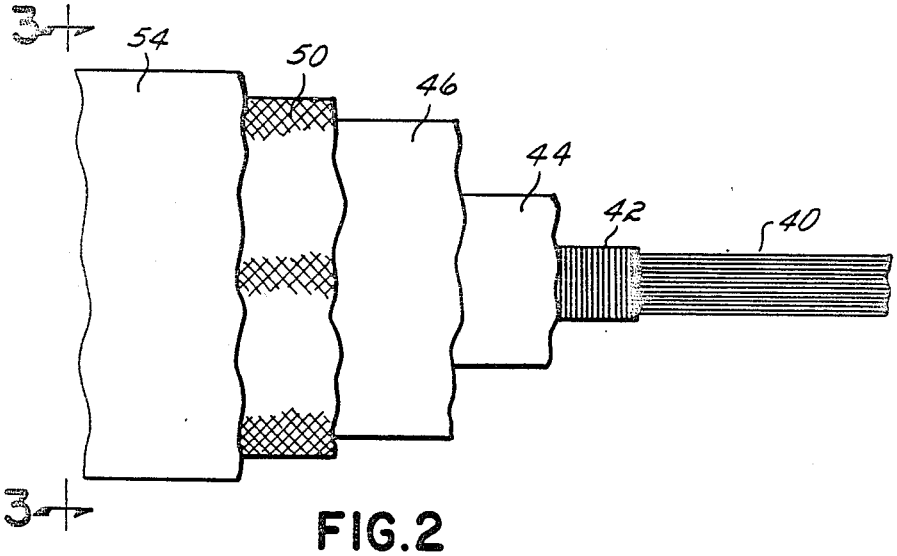
FIG. 2 is a front elevational view, partially cut away of the preferred high voltage cable, showing the various elements thereof.
Figure 3:
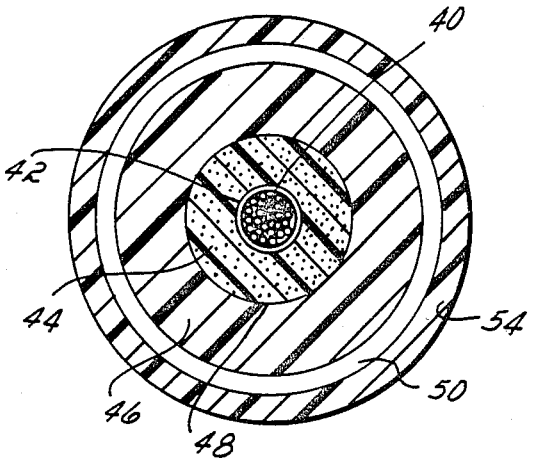
FIG. 3 is a cross-sectional view transversely through the cable along line 3—3, showing the various concentric sheaths or layers of the preferred cable.

The improved electrically insulated cable 20, which is shown in detail in FIGS. 2 and 3, includes a relatively flexible elongated core 40 fabricated of a plurality of substantially continuous silicon carbide fibers which conduct electrical current substantially longitudinally along the length of the core. In a preferred form, the core 40 comprises four 500-filament strands, with each filament being a substantially continuous silicon carbide fiber having a diameter of approximately 0.0005 inches. The resistive silicon carbide fiber core 40 in the preferred form has a diameter less than 0.05" preferably between 0.03 and 0.04 inches and most preferably 0.035 inches and can be constructed in accordance with the teachings of the Hastings et al application referenced earlier, the entire disclosure which is specifically incorporated herein by reference. The resistivity of this core 40 should be about $10^3$ ohm-cm.

Completely encasing the resistive silicon carbide fiber core 40 is a layer of insulative thread 42 which is spirally wound, or served, around the outer surface of the core 40. The thread, which is preferably Dacron brand polyester, is tightly wound around the exterior surface of the resistive fiber core 40, with the adjacent convolutions of the spirally wound thread being in physical contact with each other, thereby snugly embracing in radially inwardly compressive fashion the entire exterior surface of the silicon carbide fiber core 40. In a preferred form the Dacron brand polyester thread has a denier of 1100 providing a pitch for the spirally wound thread of ⅜ inches. The outside diameter of sheath 42 in the preferred embodiment is 0.060 inches.

The spirally threaded layer 42 snugly encasing the entire resistive fiber core 40 serves several important functions. More particularly, the layer 42 restricts, restrains, inhibits or prevents the confronting end of a broken filament of the silicon carbide fiber core 40 from projecting radially outwardly from the generally cylindrically shaped core 40, which if permitted to occur would create very high voltage gradients or stresses due to the extremely small diameter of the broken silicon carbide filament. In addition, the threaded layer or sheath 42 protects the silicon carbide fiber core 40 from damage when it is pulled through an extruding die in the course of extruding the next outermost sheath 44 to be described. The threaded layer 42 provides the further function of preventing broken silicon carbide filaments of the core 40 from accumulating upstream of the extruding die orifice, that is "balling up", when the core 40 is pulled through the extruding die in the process of extruding the sheath 44.

While the sheath 42 is preferably fabricated of Dacron brand polyester thread, other functionally equivalent layers can be used providing, among other things, that they matt down broken filament ends of the silicon carbide fiber core 40, preventing the broken ends from projecting radially outwardly from the core. It is also desirable that the layer 42 be flexible, relatively nonabsorbent with respect to moisture, and capable of withstanding the extruding temperature of the sheath 44 which surrounds it. Illustrative of suitable substitutes for Dacron brand polyester for the layer 42 are polyamides such as nylons, polyurethane, Mylar and other polyesters such as PET. Instead of thread, the sheath 42 can be fabricated of spirally wound flat ribbon.

The sheath 44 which is extruded directly over the spirally wound threaded layer or sheath 42 preferably is fabricated of carbon-loaded polyethylene. The carbon-loaded polyethylene sheath 40 tightly embraces the outer surface of the threaded layer or sheath 42, and in the preferred embodiment has an outside diameter of 0.11 inches. The resistivity of the layer or sheath 44 is selected to lie between that of the resistivity of the core 40 and the resistivity of the dielectric sheath 46 described hereafter. Generally it will have a resistivity of $10^6$–$10^8$ ohm-cm and preferably $10^7$ ohm-cm.

With the resistivity and diameter of the sheath 44 selected as described above, the relatively high resistive sheath functions to provide uniform voltage stress distribution in the region immediately surrounding the thread-covered core 40, thereby avoiding internal corona sites which cause degradation of the dielectric sheath 46 which might otherwise occur due to the very small diameter of the silicon carbide core 40 and the very high operating voltages at which the core is energized during operation. The sheath 44 also functions to eliminate high voltage stress points produced by any stray broken fiber ends which may project from the core 40 through the threaded layer 42. As noted earlier, the extremely small diameter of the silicon carbide filaments used in the core 40, if permitted to project outwardly from the core, should a broken filament occur, can create very high voltage gradients. By embedding in the relatively highly resistive extruded sheath 44 the stray ends of a broken silicon carbide filament, which ends may stray and project through the threaded layer 42 from the core 40, the high voltage gradients which would otherwise tend to occur are markedly reduced. This in turn reduces the tendency of the dielectric sheath 46, used to insulate the high voltage resistive core 40, to prematurely fail at the site of the ends of the protruding broken silicon carbide filament.

Although the voltage stress reducing sheath 44 is preferably fabricated of carbon-loaded polyethylene, such as high molecular weight, low density Alathon brand polyethylene, other functionally equivalent materials may be used which are suitably doped or loaded or otherwise formulated or fabricated to provide the desired resistivity and which exhibit the requisite flexibility, non-absorbency, and thermal stability at the extrusion temperature of the dielectric sheath 46.

The dielectric sheath 46 principally performs the function of electrically insulating the resistive silicon carbide fiber core 40 at the high voltages encountered during operation, such as 50 k.v. or more. The sheath 46 is extruded over the sheath 44 to a thickness which, depending upon the dielectric properties of the material, is sufficient to insulate the resistive core 40 for the high voltage encountered in operation. In the preferred embodiment of the invention designed to operate at voltages of 150 kv, the dielectric sheath 46 has an outer diameter of 0.205 inches and a resistivity in the range of $10^{14}$–$10^{16}$ ohm-cm. To minimize voids or spaces, at the interface 48 between the outer surface of the sheath 44 and thereby the inner surface of the sheath 46, and the resulting localized corona sites which degrade the sheath 46, ultimately causing cable failure, it is desirable that the mating surfaces of the sheaths 44 and 46 be in intimate physical contact throughout the entirety of the interface therebetween. In a preferred form of the invention, this void-free condition is achieved by bonding the mating surfaces of the sheaths 44 and 46 throughout the entirety of their interface 48. This bonding is achieved, in the preferred embodiment, by selecting a material for the dielectric sheath 46 which will blend or chemically cross-link with the material of the sheath 44 at the interface 48. The requisite cross-linking or blending occurs, in the preferred embodiment, by fabricating the sheaths 44 and 46 of the same polymer, for example, polyethylene. Other forms of bonding at the interface 48 between the sheaths 44 and 46 may be employed, such as, melting the mating surfaces into each other, ultrasonic welding, adhering, or wetting the mating surfaces to compatibilize the materials, etc.

While the sheaths 44 and 46 of the preferred embodiment are both fabricated of polyethylene, with only the sheath 44 being carbon-loaded, blending of the mating surfaces of the sheaths 44 and 46 at the interface 48 thereof can be achieved using other functionally equivalent materials. For example, both sheaths 44 and 46 can be fabricated of polypropylene, or of different but yet compatible co-polymers such as ethylene propylene copolymer and ethylene propylene diene terpolymers. Sheaths 44 and 46 can be formed of two different materials which are reactive with each other to form a chemical bond or crosslink at this interface. Further, if sheaths 44 and 46 are formed of incompatible materials, a compatibilizing layer can be incorporated between the two layers to avoid any interfacial void.

Surrounding the dielectric sheath 46 is an electrically grounded conductive braid layer or sheath 50 having an outside diameter of approximately 0.233 inches. Surrounding the conductive braid sheath 50 is a two-mill thick layer of Mylar brand polyester ribbon 52 wrapped to provide a 50% overlap, producing an outside diameter of 0.241 inches. The Mylar layer 52 is provided with a layer of polyurethane 54 having a thickness of approximately 0.036 inches, providing an outside diameter of 0.313 inches.

The electrically grounded conductive braid 50 is provided for safety reasons in the event the dielectric sheath 46 should fail to electrically insulate the high voltage core 40. The polyurethane outer layer 54 provides a tough, abrasion-resistant protective cover for the cable.

What is claimed is:

1. An electrically insulated high voltage cable comprising:

an elongated resistive element of substantially continuous silicon carbide filaments disposed to provide electrical current flow paths primarily in a substantially longitudinal direction therealong, said element being susceptive of having broken filaments which produce filament ends having a tendency to project radially outwardly relative to said longitudinal direction thereof, elongated restraining means spirally-wrapped around and surrounding said resistive element for restraining said filament ends against outward movement to minimize radially outward projection thereof, adjacent convolutions of said restraining means being in close physical proximity with one another and without substantial gaps therebetween whereby to encase substantially the entirety of said resistive element, and a dielectric sheath surrounding said restraining means for insulating said resistive element for safe operation at high voltages.

2. The cable of claim 1 wherein said restraining means compresses said filament ends radially inwardly relative to said longitudinal direction of said filaments.

3. The cable of claim 2 wherein said restraining means includes thread spirally wrapped around said resistive element.

4. The cable of claim 3 wherein said thread encases substantially the entirety of said resistive element.

5. The cable of claim 4 wherein said thread is fabricated of dielectric material.

6. The cable of claim 5 wherein said dielectric thread is polyester derived from polyethylene terephthalate.

7. The cable of claim 1 further comprising an intermediate sheath disposed between said restraining means and said dielectric sheath, said intermediate sheath having a resistivity value intermediate the resistivities of said resistive silicon carbide element and said dielectric sheath.

8. The cable of claim 7 wherein the resistivity of said silicon carbide filaments is approximately $10^3$ ohm-cm., the resistivity of said intermediate sheath is approximately $10^7$ ohm-cm.

9. The combination of claim 8 wherein the resistivity of said dielectric sheath is approximately $10^{15}$ ohm-cm.

10. The cable of claim 7 wherein said resistive silicon carbide element has a diameter less than approximately 0.05".

11. The cable of claim 9 wherein said resistive silicon carbide element has a diameter in the approximate range of 0.03"–0.04".

12. The cable of claim 7 wherein said silicon carbide filaments have a diameter of approximately 0.0005".

13. The cable of claim 7 wherein the diameter of said silicon carbide element is approximately 0.05", the outside diameter of said intermediate sheath is approximately 0.1", and the outside diameter of said dielectric sheath is approximately 0.2".

14. The cable of claim 7 wherein said intermediate sheath and said dielectric sheath are bonded at the interface therebetween.

15. The cable of claim 7 wherein said intermediate sheath and dielectric sheath are chemically cross-linked at the interface therebetween.

16. The cable of claim 7 wherein said intermediate sheath and dielectric sheath are fabricated of substantially the same polymer, with the intermediate sheath being carbon-loaded.

17. The cable of claim 16 wherein said polymer is polyethylene.

18. The cable of claim 7 wherein said intermediate sheath and said dielectric sheath are in intimate physical contact throughout substantially the entirely of the interface therebetween to minimize localized potential corona sites when said silicon carbide fiber element is energized with high voltage.

19. The cable of claim 18 wherein said intermediate and dielectric sheaths collectively are flexible.

20. The cable of claim 18 wherein said intermediate and dielectric sheaths are fabricated of substantially the same polymer, with the intermediate sheath being carbon-loaded.

21. For use in an electrostatic spray coating system having a high voltage electrostatic supply, the combination comprising:

A spray coating device for emitting charged coating particles toward an article to be coated;

an electrode mounted to said device in charging relationship to coating particles emitted by said spray device;

an elongated resistive element of substantially continuous silicon carbide filaments disposed to provide electrical current flow paths primarily in a substantially longitudinal direction therealong, said element being susceptive of having broken filaments which produce filament ends having a tendency to project radially outwardly and relative to said longitudinal direction thereof, said resistive element electrically communicating with said high voltage electrostatic supply and said electrode, elongated restraining means spirally-wrapped around and surrounding said resistive element for restraining said filament ends against outward movement to minimize radially outward projection thereof, adjacent convolutions of said restraining means being in close physical proximity with one another and without substantial gaps therebetween whereby to encase substantially the entirety of said resistive element, and a dielectric sheath surrounding said restraining means for insulating said resistive element for safe operation at high voltages.

22. The combination of claim 21 wherein said restraining means compresses said broken filament ends radially inwardly relative to said longitudinal direction of said filaments.

23. The combination of claim 22 wherein said restraining means includes thread spirally wrapped around said silicon carbide element.

24. The combination of claim 23 wherein said thread encases substantially the entirety of said silicon carbide element.

25. The combination of claim 24 wherein said thread is fabricated of dielectric material.

26. The combination of claim 21 further comprising an intermediate sheath disposed between said restraining means and said dielectric sheath, said intermediate sheath having a resistivity value intermediate the resistivities of said silicon carbide element and said dielectric sheath.

27. The combination of claim 26 wherein said intermediate sheath and dielectric sheath are bonded at the interface therebetween.

28. The combination of claim 26 wherein said intermediate sheath and dielectric sheath are chemically cross-linked at the interface therebetween.

29. The combination of claim 26 wherein said intermediate sheath and dielectric sheath are fabricated of substantially the same polymer, with the intermediate sheath being carbon-loaded.

30. The combination of claim 29 wherein said polymer is polyethylene.

31. The combination of claim 26 wherein said intermediate sheath and said dielectric sheath are in intimate physical contact throughout substantially the entirety of the interface therebetween to minimize localized potential corona sites when said silicon carbide element is energized with high voltage.

32. The combination of claim 31 wherein said intermediate and dielectric sheaths collectively are flexible.

33. The combination of claim 31 wherein said intermediate sheath and dielectric sheath are fabricated of substantially the same polymer, with the intermediate sheath being carbon-loaded.

* * * * *